US006152309A

United States Patent [19]

Price et al.

[11] Patent Number: 6,152,309

[45] Date of Patent: Nov. 28, 2000

[54] MULTIPLE-PATH CONVEYOR WITH LOCKABLE PATH SELECTOR

[75] Inventors: John Gerwyn Price, Hampshire, United Kingdom; Lars Svensson, Flen, Sweden

[73] Assignee: De La Rue Cash Systems AB, Flen, Sweden

[21] Appl. No.: 09/168,944

[22] Filed: Oct. 9, 1998

[30] Foreign Application Priority Data

Nov. 4, 1997 [SE] Sweden ..... 9704023

[51] Int. Cl.[7] ..... B07C 9/00

[52] U.S. Cl. ..... 209/657; 209/918; 271/303

[58] Field of Search ..... 209/534, 651, 209/652, 656, 657, 918; 271/303, 305

[56] References Cited

U.S. PATENT DOCUMENTS

| | | | |
|---|---|---|---|
| 5,151,742 | 9/1992 | Yamaguchi | 271/303 X |
| 5,909,814 | 6/1999 | Arikawa | 209/534 |

FOREIGN PATENT DOCUMENTS

| | | | |
|---|---|---|---|
| 476769 | 3/1992 | European Pat. Off. | 209/657 |
| 0 866 429 A1 | 9/1998 | European Pat. Off. . | |
| 0866429 | 9/1998 | European Pat. Off. . | |
| 3808333 | 9/1989 | Germany | 209/657 |
| 3900445 | 7/1990 | Germany . | |
| 658024 | 10/1986 | Switzerland . | |

*Primary Examiner*—Tuan N. Nguyen
*Attorney, Agent, or Firm*—Oliff & Berridge, PLC

[57] ABSTRACT

A conveying arrangement includes a path selector including a selector slide that is selectively positionable at first and second positions, thereby connecting a first conveyor path with a first further conveyor path or a second further conveyor path. The selector slide is actuated by a guide arm that moves the slide from the first position to the second position, and vice versa. The selector slide is locked firmly in at least one of the positions by a locking arm that is moved to and from a locking position by the guide arm. The selector slide may have a fixed pin that interacts with a first recess or aperture formed in the locking arm, and the recess may have first and second pin-receiving end positions corresponding to the first and second positions of the selector slide. The guide arm may be pivotally mounted and have a second recess or aperture that actuates the fixed pin and a locking-arm actuating guide pin that interacts with a camming surface on the locking arm.

6 Claims, 2 Drawing Sheets

MULTIPLE-PATH CONVEYOR WITH LOCKABLE PATH SELECTOR

FIELD OF THE INVENTION

The present invention relates to a conveyor arrangement that includes selector means which functions to set a selector slide included in said selector means to either one of two positions for connecting a first conveyor path to either one of two further conveyor paths. The selector slide is moved from a first position to a second position, and vice versa, by means of a guide arm.

DESCRIPTION OF THE PRIOR ART

It is known in connection with banknote handling machines to transport bundles of banknotes, e.g., from a space that accommodates banknote cassettes in the machine, either to an outfeed opening or to a space for nonaccepted banknotes, with the aid of a "carriage" provided with driving cog wheels and cog railways mounted in the machine. The banknotes are thus conveyed to either one of two further conveyor paths over a first conveying path, wherein a selector slide acts as a switch to mutually couple conveyor paths, so as to establish a desired total conveyor path, e.g. comprising the first conveyor path connected via a switch (a path selector) to the further conveyor path that leads either to the outfeed opening or to the space for nonaccepted banknotes. An example is described in EPA-0866429.

It has been found in practice that cogs on one side of the carriage can "derail" due to the play that occurs as a result of variations in tolerance of the mechanical component parts. Certain assembly problems also contribute to this undesirable effect. This derailment results in the carriage being positioned obliquely on the cog railway, such that position sensors at the end positions of the carriage are unable to "see" the carriage, causing a stop in transportation. Attempts have been made to negate the influence of this play with, e.g., a separate spring arrangement which functions to force the selector slide into its correct position. The carriage, however, will still sometimes derail, despite this improvement.

The object of the present invention is to eliminate the causes of such derailment.

SUMMARY OF THE INVENTION

In accordance with the present invention, a conveyor arrangement includes a path selector means which functions to set a selector slide included in the selector means in either one of first and second positions so as to connect a first conveyor path with a respective one of two further conveyor paths, wherein the arrangement includes a guide arm which functions to move the slide from the first position to the second position and vice versa and is characterised by a locking arm which functions to lock the selector slide in one of said first and said second positions, said locking arm being moved into and out of said locking positions by said guide arm.

BRIEF DESCRIPTION OF THE DRAWINGS

An example of the invention will now be described in more detail with reference to the accompanying drawings, in which.

DETAILED DESCRIPTION OF THE EMBODIMENT

Figure 1:
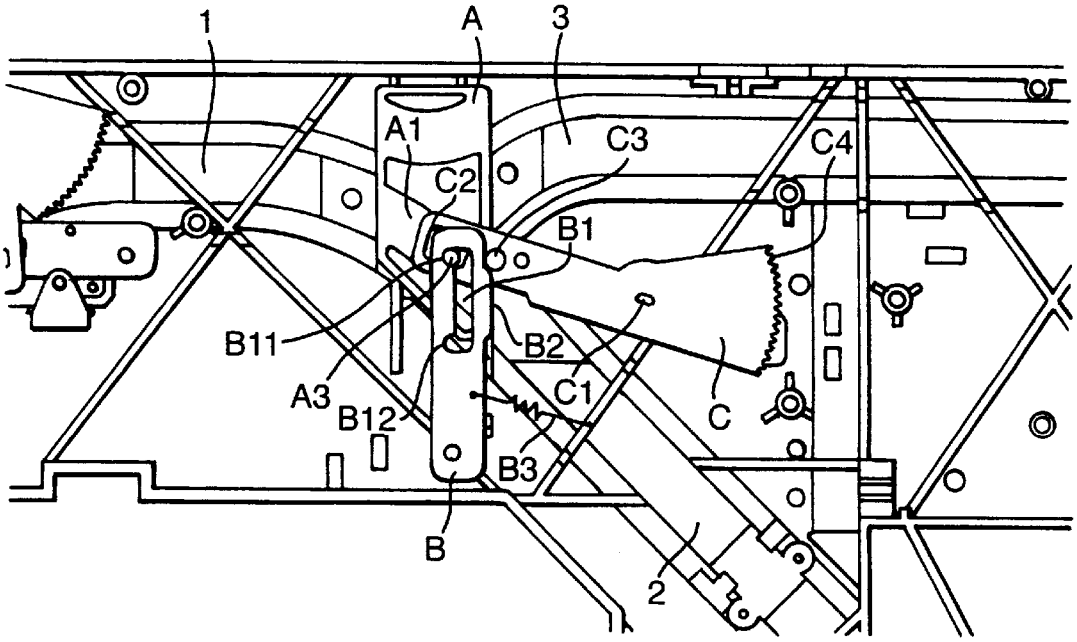
FIG. 1 illustrates a conveyor arrangement having a first conveyor path, path selector means, and further conveyor paths, and shows a selector slide in an outer position.

The conveyor arrangement illustrated in FIG. 1 includes a first conveyor path 1 and two further conveyor paths 2 and 3. Located between the first conveyor path and the further conveyor paths is a path selector means A-B-C which includes a selector slide A, a locking arm B and a guide arm C. When the selector slide is in a first position A1 (upper position), the conveyor paths 1 and 2 form a continuous conveyor path 1–2, whereas when the selector slide is in a second position A2 (lower position, see FIG. 3), the conveyor paths 1 and 3 together form a continuous conveyor path 1–3.

The guide arm C functions to move the selector slide A from the first position A1 to the second position A2, and vice versa, and is locked in each of said positions by means of the locking arm B.

The selector slide A has a fixed pin A3 which co-acts with a first recess or aperture B1 in the locking arm B. The recess or aperture B1 has two pin-receiving end positions B11 and B12 which correspond to said two positions A1, A2 of the selector slide. The arrangement includes a pull spring B3 which rotates the locking arm B in a clockwise direction for positive abutment between a camming surface B2 on an external surface of the arm B and a guide pin C3 or the guide arm C.

The guide arm C is pivotally mounted about a pivot pin C1 and includes a second recess or aperture C2 which receives, and is arranged to actuate, pin A3 and the locking-arm actuating guide pin C3 arranged for co-action with the camming surface B2 on the locking arm B.

When the conveyor arrangement is in the mode shown in FIG. 1, the conveyor paths 1 and 2 form a continuous conveying path via the selector slide A in its upper position; the slide A is locked in this upper position by virtue of the pin A3 lying in the upper end position B11, while the locking arm B is locked in the illustrated position by virtue of the abutment of the pin C3 with the camming surface B2 and the pulling force exerted on the locking arm B by the spring B3.

Figure 2:
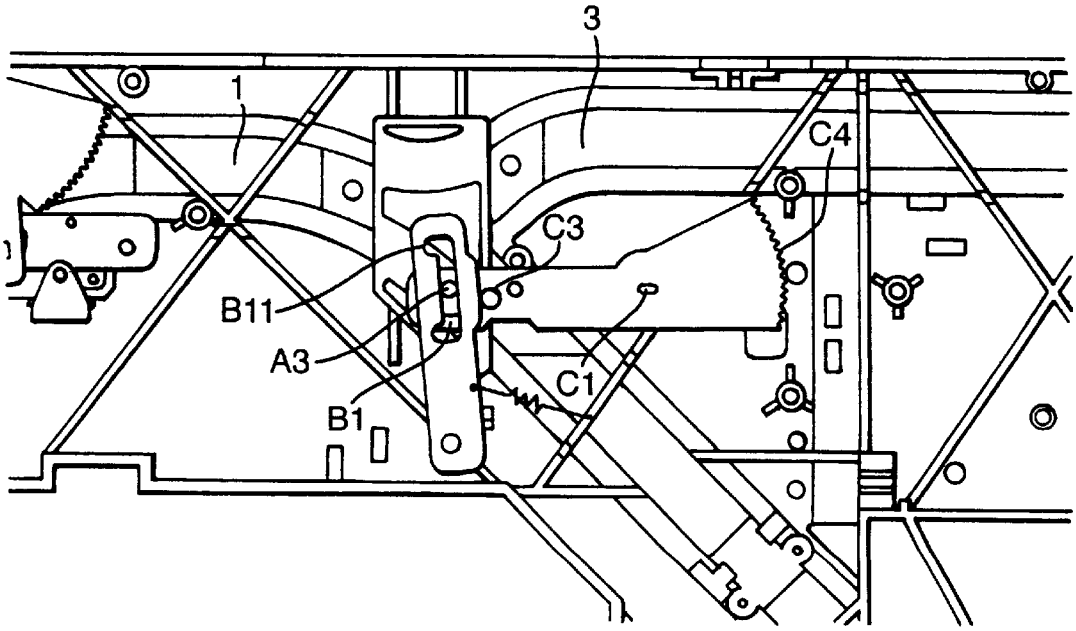
FIG. 2 shows the conveyor arrangement according to FIG. 1 with the selector slide in an intermediate position.
Figure 3:
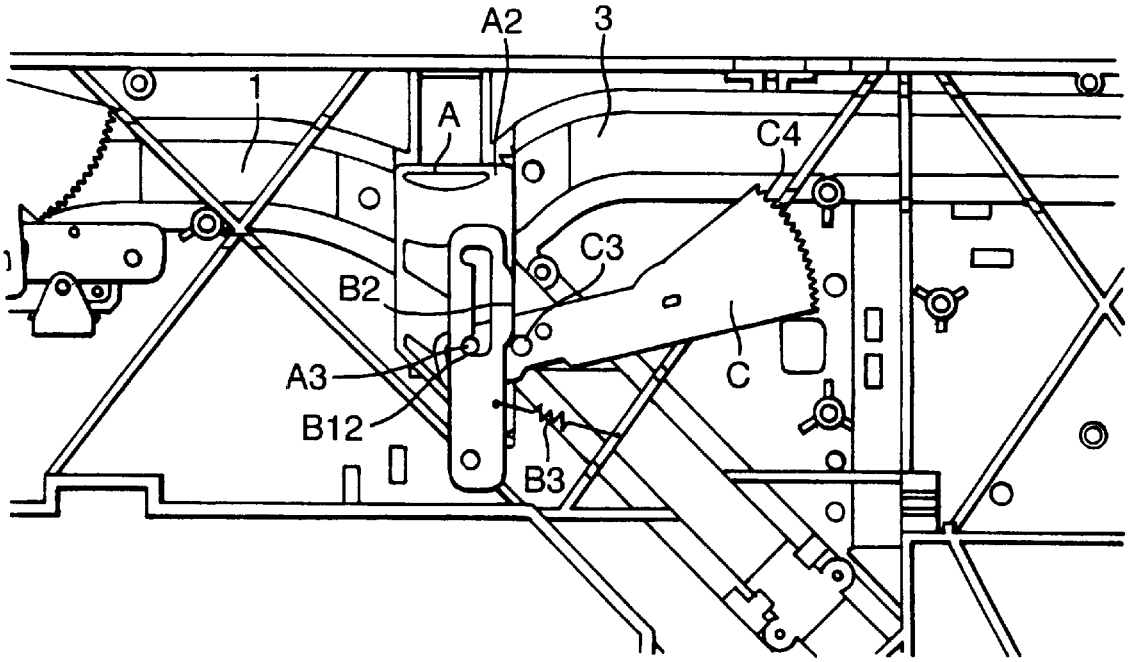
FIG. 3 shows the conveyor arrangement according to FIG. 1 with the selector slide in a second outer position.
Figure 4:
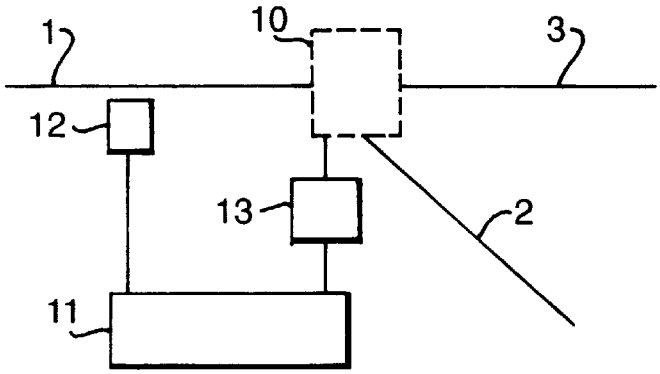
FIG. 4 is a schematic diagram of part of a banknote sorter incorporating the conveyor arrangement of FIGS. 1 to 3.

As mentioned previously, the conveyor arrangement is particularly suitable for use in banknote sorting equipment and FIG. 4 illustrates schematically part of such sorting equipment. The conveyor paths 1–3 are illustrated in FIG. 4 and the path selector means of FIGS. 1 to 3 is indicated at 10. The banknote sorter includes a microprocessor 11 which is connected to a detector 12 such as an optical detector. Banknotes are supplied along the conveyor path 1 in a conventional manner and the detector 12 detects a particular characteristic of the banknotes. This might be their length, width or information on the banknotes. This information is transmitted to the microprocessor 11 which determines whether the banknote should be conveyed to the conveyor path 3 or to the conveyor path 2. If the selector slide A is incorrectly located, the controller 3 activates a stepper motor 13 coupled to the slide A to move the slide to its other position so that the note is conveyed to the correct path.

In one case, the conveyor path 2 may be used for conveying unacceptable banknotes.

Thus, in the event of transporting banknotes from an infeed opening to a space for nonaccepted banknotes, an event which presumably occurs relatively seldom, the conveyor paths 1 and 3 must be arranged to form a continuous conveying path over the selector slide A in its second (lower) position A2, see FIG. 3. The microprocessor 11 installed in the machine sends signals to the stepping motor 13 which causes the guide arm C to rotate anticlockwise around the pivot pin C1, via a gear transmission including a rack and pinion mechanism, the rack on the guide arm C being shown at C4. The following then takes place; see FIG. 2.

As the guide arm C is rotated anti-clockwise, the guide pin C3 moves downwards and therewith out of its locking position with the locking arm B, which then rotates anti-clockwise. The pin A3 moves out of the end position B11 and is guided downwards by the edge of the recess C2 within the recess or aperture B1. FIG. 2 shows an intermediate position of the pin A3 when the selector slide A moves downwards.

FIG. 3 illustrates termination of the downward movement of the selector slide A. The pin A3 lies in the lower end position B12 and the locking arm B is locked in this position by virtue of abutment of the pin C3 with the camming surface B2 and the pulling force exerted by the spring B3 on the locking arm B. The conveyor paths 1 and 3 thus form a safe, continuous conveying path.

A return to the conveyor path 1–2 is made in the manner described in the aforegoing, but in the reverse order.

What is claimed is:

1. A conveyor arrangement, comprising:

a path selector comprising a selector slide that is selectively positionable in a first position, in which the selector slide connects a first conveyor path with a first further conveyor path, and a second position, in which the selector slide connects the first conveyor path with a second further conveyor path;

a guide arm that moves the selector slide from the first position to the second position and vice versa; and a locking arm that locks the selector slide in at least one of said first and second positions when said locking arm is in a locking position, said locking arm being moved into and out of said locking position by said guide arm.

2. A conveyor arrangement according to claim 1, wherein:

the selector slide includes a fixed pin that interacts with a first recess or aperture provided in the locking arm, the first recess or aperture having first and second pin-receiving positions for said fixed pin corresponding to said first and second positions of said selector slide;

the guide arm is pivotally mounted and has a second recess or aperture arranged to actuate said fixed pin and a locking-arm actuating guide pin that interacts with a camming surface on the locking arm, whereby, when the selector slide is positioned in one of said first and second positions, the locking arm locks the selector slide in this position and the locking arm is locked by said fixed pin being positioned in one of said pin-receiving positions.

3. A conveyor arrangement according to claim 2, wherein said first and second pin-receiving positions are located at respective ends of said first recess or aperture.

4. A conveyor arrangement according to claim 1, wherein said locking arm locks the selector slide in both of said first and second positions.

5. A conveyor arrangement according to claim 1, wherein said selector slide is slidably movable between said first and second positions.

6. Banknote sorting apparatus, comprising:

a first conveyor path and first and second further conveyor paths coupled by a conveyor arrangement, the conveyor arrangement comprising:

a path selector comprising a selector slide that is selectively positionable in a first position, in which the selector slide connects a first conveyor path with a first further conveyor path, and a second position, in which the selector slide connects the first conveyor path with a second further conveyor path, a guide arm that moves the selector slide from the first position to the second position and vice versa, and a locking arm that locks the selector slide in at least one of said first and second positions when said locking arm is in a locking position, said locking arm being moved into and out of said locking position by said guide arm;

a detector that detects a characteristic of a banknote fed along the first conveyor path; and a processor connected to the detector that controls the guide arm to position the selector slide to connect the first conveyor path to an appropriate one of the first and second further conveyor paths.

* * * * *